US008214091B2

(12) United States Patent
Kernwein

(10) Patent No.: US 8,214,091 B2
(45) Date of Patent: Jul. 3, 2012

(54) SYSTEM AND METHOD TO DETERMINE TRAIN LOCATION IN A TRACK NETWORK

(75) Inventor: Jeffrey D. Kernwein, Cedar Rapids, IA (US)

(73) Assignee: Wabtec Holding Corp., Wilmerding, PA (US)

( * ) Notice: Subject to any disclaimer, the term of this patent is extended or adjusted under 35 U.S.C. 154(b) by 1179 days.

(21) Appl. No.: 11/874,430

(22) Filed: Oct. 18, 2007

(65) Prior Publication Data

US 2009/0105893 A1 Apr. 23, 2009

(51) Int. Cl.
*G05D 1/00* (2006.01)

(52) U.S. Cl. ..... 701/19; 701/414; 701/469; 701/482; 246/122 R

(58) Field of Classification Search ..... 701/19, 701/20, 213, 214; 246/122 R, 123, 124
See application file for complete search history.

(56) References Cited

U.S. PATENT DOCUMENTS

| | | | | |
|---|---|---|---|---|
| 5,129,605 | A * | 7/1992 | Burns et al. | 246/5 |
| 5,740,547 | A * | 4/1998 | Kull et al. | 701/19 |
| 5,950,966 | A * | 9/1999 | Hungate et al. | 246/62 |
| 5,978,718 | A * | 11/1999 | Kull | 701/19 |
| 5,995,881 | A * | 11/1999 | Kull | 701/20 |
| 6,218,961 | B1 | 4/2001 | Gross et al. | |
| 6,311,109 | B1 | 10/2001 | Hawthorne et al. | |
| 6,360,998 | B1 | 3/2002 | Halvorson et al. | |
| 6,373,403 | B1 | 4/2002 | Korver et al. | |
| 6,374,184 | B1 | 4/2002 | Zahm et al. | |
| 6,456,937 | B1 * | 9/2002 | Doner et al. | 701/213 |
| 6,480,766 | B2 | 11/2002 | Hawthorne et al. | |
| 6,641,090 | B2 | 11/2003 | Meyer | |
| 6,845,953 | B2 | 1/2005 | Kane et al. | |
| 6,865,454 | B2 | 3/2005 | Kane et al. | |
| 6,996,461 | B2 | 2/2006 | Kane et al. | |
| 7,079,926 | B2 | 7/2006 | Kane et al. | |
| 7,142,982 | B2 | 11/2006 | Hickenlooper et al. | |

(Continued)

FOREIGN PATENT DOCUMENTS

JP 2006213084 A 8/2006

(Continued)

OTHER PUBLICATIONS

Schiestl, A Sense of Place GPS and Alaska Rail Safety, GPS World, Mar. 2004, pp. 14-19.

*Primary Examiner* — Thomas Black
*Assistant Examiner* — Peter D Nolan
(74) *Attorney, Agent, or Firm* — The Webb Law Firm

(57) ABSTRACT

A system for determining a possible location of a train in a track network including interconnected tracks having wayside devices associated with these tracks. The system includes a positioning system for determining an estimated location area of a train and a track database having track location data. A computer: obtains the determined estimated location area of the train from the positioning system; identifies a plurality of tracks in the estimated location area of the train, based upon the track location data; obtains signal system data for at least one wayside device associated with at least one of the tracks identified within the estimated location area; and determines at least one possible train location on at least one of the identified tracks based at least in part upon the obtained signal system data. A method and apparatus for determining the possible location of a train is also provided.

21 Claims, 3 Drawing Sheets

U.S. PATENT DOCUMENTS

| | | | | |
|---|---|---|---|---|
| 7,236,860 | B2 | 6/2007 | Kane et al. | |
| 7,269,487 | B2 * | 9/2007 | Watanabe et al. | 701/19 |
| 7,395,140 | B2 * | 7/2008 | Christie et al. | 701/19 |
| 7,618,010 | B2 * | 11/2009 | Fries | 246/122 R |
| 7,650,207 | B2 * | 1/2010 | Metzger | 701/19 |
| 7,729,819 | B2 * | 6/2010 | Rajaram | 701/19 |
| 2004/0140405 | A1 * | 7/2004 | Meyer | 246/122 R |
| 2005/0010338 | A1 * | 1/2005 | Kraeling et al. | 701/19 |
| 2005/0065726 | A1 | 3/2005 | Meyer et al. | |
| 2005/0107954 | A1 * | 5/2005 | Nahla | 701/301 |
| 2005/0205719 | A1 * | 9/2005 | Hendrickson et al. | 246/122 R |
| 2006/0212183 | A1 * | 9/2006 | Wills et al. | 701/19 |
| 2006/0253233 | A1 | 11/2006 | Metzger | |
| 2006/0271291 | A1 | 11/2006 | Meyer | |
| 2007/0219682 | A1 * | 9/2007 | Kumar et al. | 701/19 |
| 2008/0042015 | A1 * | 2/2008 | Plawecki | 246/122 R |
| 2008/0055043 | A1 * | 3/2008 | Webb et al. | 340/10.1 |
| 2009/0043435 | A1 * | 2/2009 | Kane et al. | 701/19 |

FOREIGN PATENT DOCUMENTS

| | | | |
|---|---|---|---|
| KR | 100439010 | B1 | 6/2004 |
| WO | 2007107424 | A1 | 9/2007 |

* cited by examiner

SYSTEM AND METHOD TO DETERMINE TRAIN LOCATION IN A TRACK NETWORK

BACKGROUND OF THE INVENTION

1. Field of the Invention

The present invention relates generally to methods, systems and apparatus for determining the position or location of vehicles in a transit network and, in particular, to a system and method for determining the location or position of a train or locomotive in a track network made up of multiple interconnected tracks, where wayside (signal system) devices are placed or positioned throughout the track network and associated with the specific portions or blocks of track over which the train traverses.

2. Description of Related Art

Train control systems provide many advantages to controlling, monitoring and tracking trains traversing tracks in a track network. For example, such train control systems provide protection against train-to-train collisions, protection against overspeed derailments, as well as protection against collisions between trains, equipment, personnel, vehicles and other objects. In order to provide such protection, the train control system must obtain data and information about the location of the various trains in the network, work crews, sections of track that have operating speeds below maximum track speed, etc. Such data is made available to the train control system normally through a combination of an on-board track database, as well as radio communications through which other train locations and dynamic information, e.g., temporary speed restrictions, switch alignment, etc., is conveyed. Knowing the restrictions in front of the train is an important part of the equation for providing protection, and additionally, the present location or position of the train is required to make important control decisions.

According to the prior art, current navigation systems are available and used for train control. For example, such existing systems use a combination of a positioning system, e.g., a Global Positioning System (GPS), and tachometer speed. This combination provides a general location of the train, but cannot provide the resolution required to differentiate between adjacent tracks with the degree of certainty required to safely navigate in areas of parallel tracks, or multiple tracks in a specified and identified area.

Various methods exist to augment navigation in order to distinguish between one track and another. One such method includes monitoring switch position, e.g., normal or reserve, and transmitting that information to the locomotive in order to determine the route that will be taken through a switch. Another method includes the use of inertial sensors to determine yaw of the locomotive, with software to translate that information and data into movement through a switch. Yet another method is implemented through the use of transponders affixed to the rail bed with readers on each locomotive to interrogate those transponders, and determine which path has been taken through a switch.

Each of the above-referenced methods provides some functionality, but each also realizes various hazards and deficiencies, which would result in an incorrect determination of the train route through a switch. For example, if a switch monitor or radio interface is non-functional, the train control system will need to rely upon an operator to instruct the system as to which route was taken. This is also true with the transponder solution, if a tag or reader is damaged. In addition, potential errors exist with inertial navigation systems that make them ineffective in determining a route through a switch, such as long turnouts with little deviation, or switches located on curved track, where both the normal and reverse paths result in some angular deflection.

Another drawback that exists is the precision of a GPS or navigational system. While such a navigational or positioning system is capable of providing a fairly granular estimation of the train location, what is provided is a roughly circular area that provides only an estimated position of an object, in this case a train. However, this circular area or estimated position provides a location where the object or train can be anywhere within the circle. Such error is known in the railroad industry as cross track error and requires the additional functions discussed above in order to ensure appropriate positioning data as obtained or calculated.

As discussed above, various existing methods and systems are available in order to estimate train location in a track network. For example, one or more of the following patents/publications describe train control systems or functions that have some positioning ability: U.S. Publication No. 2006/0271291 to Meyer; U.S. Pat. No. 7,142,982 to Hickenlooper et al.; U.S. Publication No. 2006/0253233 to Metzger; U.S. Pat. No. 7,079,926 to Kane et al.; U.S. Pat. No. 6,996,461 to Kane et al.; U.S. Publication No. 2005/0065726 to Meyer et al.; U.S. Pat. No. 6,865,454 to Kane et al.; U.S. Pat. No. 6,641,090 to Meyer; U.S. Pat. No. 6,480,766 to Hawthorne et al.; U.S. Pat. No. 6,456,937 to Doner et al.; U.S. Pat. No. 6,374,184 to Zahm et al.; U.S. Pat. No. 6,373,403 to Korver et al.; U.S. Pat. No. 6,360,998 to Halvorson et al.; U.S. Pat. No. 6,311,109 to Hawthorne et al.; U.S. Pat. No. 6,218,961 to Gross et al.; and U.S. Pat. No. 5,129,605 to Burns et al.

As discussed, the various prior art systems and methods exhibit certain drawbacks and deficiencies. In addition, many of these solutions and systems are amenable to further augmentation or beneficial functioning in order to provide greater confidence that the overall navigational system has determined the correct path and location of the train. In addition, and when it comes to safety on and along the tracks in a track network, additional validation and determination of exact train location is of the utmost importance.

SUMMARY OF THE INVENTION

It is, therefore, an object of the present invention to provide a system and method for determining train location in a track network that overcomes the drawbacks and deficiencies in the art of train control systems and the like. It is another object of the present invention to provide a system and method for determining train location in a track network that allows for the appropriate determination of a train location on a specific track in a track network. It is a still further object of the present invention to provide a system and method for determining train location in a track network that determines or chooses the best possible train position or location on a track that is part of multiple, close tracks. It is yet another object of the present invention to provide a system and method for determining train location in a track network that can be implemented through or integrated with known and existing train control systems. It is another object of the present invention to provide a system and method for determining train location in a track network that may be utilized in a track network including multiple wayside devices (signal devices, track circuit monitoring device, etc.) associated with specific tracks, where information and data may be obtained from these wayside devices regarding signal status, track occupancy and the like.

Therefore, according to the present invention, provided is a system for determining a possible location of a train in the track network, where the track network is made up of multiple interconnected tracks having wayside devices associated with the tracks. The system includes a positioning system for determining an estimated location area of a train within the track network. A track database includes track location data, and is in communication with a computer. The computer is adapted or configured to: (i) obtain the determined estimated location area of the train from the positioning system; (ii) identify a plurality of tracks in the estimated location area of the train, based upon the track location data; (iii) obtain signal system data for at least one wayside device associated with at least one of the plurality of tracks identified within the estimated location area; and (iv) determine at least one possible train location on at least one of the identified plurality of tracks based at least in part upon the obtained signal system data.

In a further embodiment, when multiple possible train locations are determined, the computer is further configured or adapted to: determine a direction of travel of the train; determine at least one of a track route forward and a track route backward for each of the multiple possible train locations; obtain signal system data for at least one wayside device associated with at least one of the track route forward and the track route backward for at least one of the multiple possible train locations; and determine a best possible train location based upon at least one of the following: the determined direction of travel, the determined track forward, the determined track route backward, the obtained signal system data.

In a further embodiment, the computer is further configured to: determine an area of consideration based at least a part upon at least one of the track route forward and the track route backward for at least one of the multiple possible train locations; within the area of consideration, identify at least one wayside device that governs movement in the same direction the train is traveling; and obtain signal system data from the at least one wayside device. In a still further embodiment, the computer is also configured or adapted to: identify at least one wayside device in the track route forward for at least one of the multiple possible train locations; obtain signal system data from the at least one wayside device prior to and after the train is estimated to have passed the at least one wayside device; and compare the signal system data of the at least one wayside device prior to and after the train is estimated to have passed the at least one wayside device.

According to the present invention, also provided is a method for determining a possible location of a train in the track network, where the track network includes multiple interconnected tracks having multiple wayside devices associated with these tracks. The method includes: (a) obtaining a determined estimated location of the train; (b) identifying a plurality of tracks in the estimated location area of the train; (c) obtaining signal system data for at least one wayside device associated with at least one of the plurality of tracks identified within the estimated location area; and (d) determining at least one possible train location on at least one of the identified plurality of tracks based upon an obtained signal system data.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

BRIEF DESCRIPTION OF THE DRAWINGS

FIG. 3(*b*) is a schematic view of a further step of the method and system for determining train location in a track network of FIG. 3(*a*);

FIG. 4(*b*) is a schematic view of a further step of the method and system for determining train location in a track network of FIG. 4(*a*);

FIG. 5(*b*) is a schematic view of a further step of the method and system for determining train location in a rack network of FIG. 5(*a*)

DESCRIPTION OF THE PREFERRED EMBODIMENTS

Figure 1:
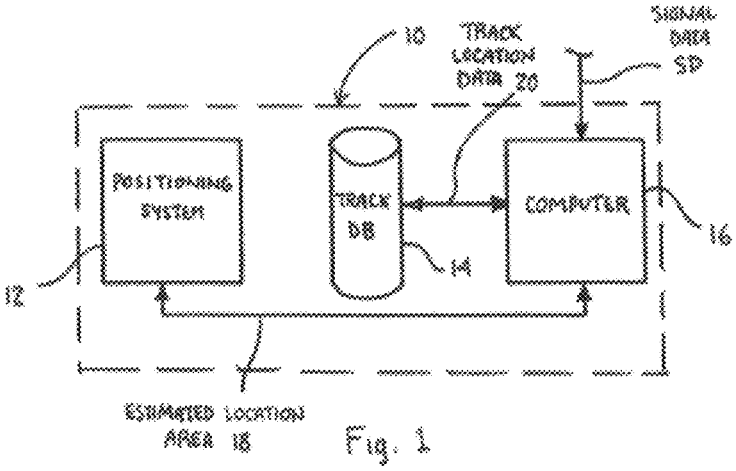
FIG. 1 is a schematic view of one embodiment of a system for determining train location in a track network according to the principles of the present invention.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

It is to be understood that the invention may assume various alternative variations and step sequences, except where expressly specified to the contrary. It is also to be understood that the specific devices and processes illustrated in the attached drawings, and described in the following specification, are simply exemplary embodiments of the invention.

According to the present invention, provided is a system 10 and method for determining the location of a train TR in a track network TN. The track network TN includes or is made up of multiple interconnected tracks T, where multiple wayside devices WD (e.g., signal devices S, track circuit monitoring devices MD, etc.) are associated with or positioned along the tracks T. As is known in the art, the wayside devices WD are used to assist the train operator in determining how the train TR should be controlled on any particular track T.

For example, and as is known in the art with respect to signal devices S, various symbols, colors and other visual indicators are used to provide the train operator with information for use in operating the train TR. For example, the colors of green, yellow and red (and associated data) may be used to indicate how the train TR is permitted to operate. For example, the color green often means clear, such that the train TR may proceed without restriction, while the color yellow may indicate that some caution or control is required. Further, the color red normally indicates that the train TR must stop (whether automatically or manually) prior to proceeding by the signal device S. Therefore, the signal system data SD provides some indication of the location of a train TR with respect to the signal S. Normally a signal device S will be used to control or otherwise provide signal system data SD with respect to a portion or block of track T that the train TR will be entering.

As also known in the art, the track network TN may be made up of multiple, interconnected tracks T, each of which is electrically isolated from the other and has an electrical potential across the two rails R in the isolated track T. This combination is known as a "track circuit", and the device that monitors the potential across the rails R is known as a track circuit monitoring device MD. The presence of a train TR on the isolated section of track T causes a short circuit and loss of electrical potential across the rails R, which is detectable by the track circuit monitoring device MD. Based upon this "short circuit" information, the track circuit monitoring device MD is capable of indicating or otherwise providing information regarding the occupancy status of the track T that is being monitored. It is this occupancy data that is provided as signal system data SD. In either case, these wayside devices WD (whether in the form of signal devices S or track circuit monitoring devices MD) may provide signal system data SD to the train TR for use in both manual control by the operator, as well as automated control by an on-board control system. This signal system data SD may also provide the appropriate indicators for making train control decisions.

The system 10 and method according to the present invention is illustrated as various embodiments and implementations in FIGS. 1-6. In one embodiment, and as illustrated in schematic form in FIG. 1, the system 10 includes a positioning system 12, as well as a track database 14. Both the positioning system 12 and the track database 14 are in communication with, i.e., able to pass data to, a computer 16.

As discussed hereinafter, and as is known in the art, the positioning system 12 is able to provide or determine an estimated location area 18. This estimated location area 18 is the "best guess" of the positioning system 12 as to the location of the train TR within the track network TN. Once this estimated location area 18 is determined or obtained, the computer 16 uses this information in coordination with track location data 20 provided from the track database 14.

Once the computer 16 has obtained the determined estimated location area 18 and identified the tracks T, this computer 16 obtains signal system data SD for at least one wayside device WD that is associated with at least one of the tracks T identified as being within the estimated location area 18. Next, at least one (and possibly multiple) possible train location is determined as being on at least one of the tracks T based upon the obtained signal system data SD. In this manner, the computer 16 is capable of determining the possible location of the train TR based upon the received signal system data SD.

Figure 2:
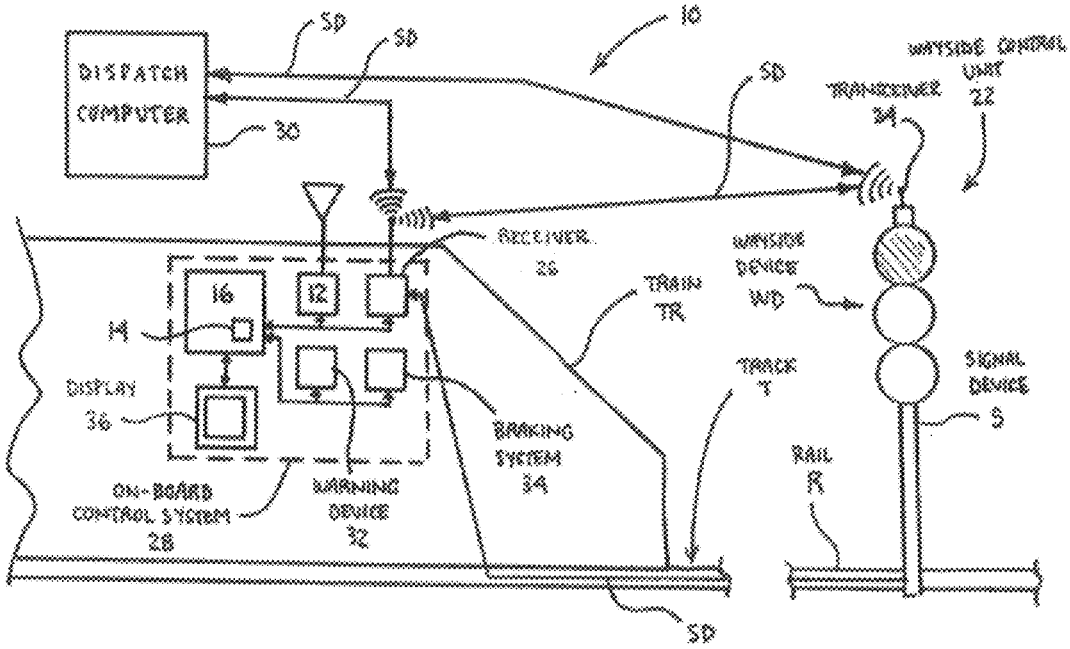
FIG. 2 is a schematic view of a further embodiment of a system for determining train location in a track network according to the principles of the present invention.

As illustrated in FIG. 2, the system 10 and method of the present invention may take many forms and implementations. For example, as seen in FIG. 2, the signal system data SD may be provided from a wayside control unit 22, such as a transceiver 24 associated with this wayside control unit 22. In this embodiment, the system 10 would further include a receiver 26 (typically in the form of a transceiver) for receiving the signal system data SD from the wayside control unit 22, as transmitted by the transceiver 24 of the wayside control unit 22. In this implementation, the information and signal system data SD would be received by the receiver 26 in a wireless form. In another embodiment, the signal system data SD would be transmitted from the wayside control unit 22 through a rail R that is part of the track T upon which the train TR is traversing. Both types of communication are known in the art and may be utilized in the context of the present invention.

In the embodiment of FIG. 2, the wayside device WD illustrated is a signal device S, which is in communication with or integrated with the wayside control unit 22. However, it is envisioned that the wayside control unit 22 could be in communication with or otherwise integrated with the track circuit monitoring device MD. In summary, regardless of the source of the signal system data SD (whether from a signal device S or a track circuit monitoring device MD), the transmission and use of this signal system data SD remains constant, i.e., used to determine the estimated location of the train TR.

The signal system data SD may take many forms. For example, this signal system data SD may be wayside device WD state data, e.g., an indication of a track condition or occupancy; wayside device WD status data, e.g., whether the signal S or wayside control unit 22 is operational; wayside device WD change data, e.g., a comparison between the wayside device WD state over a period of time; wayside device WD location data, e.g., where the wayside device WD is located or positioned with respect to the track T in the track network TN; wayside device WD behavior data, e.g., how the wayside device WD operates or otherwise functions; switch data, the state, operation or function of a switch SW; occupancy data, e.g., a direct indication of whether a track T is or is not occupied by a train TR, etc. It is the signal system data SD that is used together with the estimated location area 18 in order to determine a possible train TR location on at least one of the tracks T within this estimated location area 18.

As discussed above, the positioning system 12 may take many forms. For example, the positioning system 12 may be a global positioning system (GPS). In addition, the estimated location area 18 may take the form of a circle with a radius of tolerance (or error). See FIGS. 3(*a*)-(*b*). The use of various other positioning systems 12 is envisioned, where such systems 12 provide an estimated train TR location, which requires further resolution.

As best seen in FIG. 2, the signal system data SD is obtained for use in the presently-invented system 10 by receiving transmitted data in a wireless, hardwired or similar form and format. Of course, it is further envisioned that the signal system data SD is obtained through manual entry of an operator of the train TR based upon some visual determination. For example, the operator may provide the signal system data SD before, during or after the train TR has encountered the wayside device WD. In this manner, and with this input, the computer 16 may determine possible location of the train TR based upon this received data.

As also illustrated in FIG. 2, the positioning system 12, track database 14 and computer 16 may be located on the train TR, such as in the form of an on-board control system 28. Of course, it is also envisioned that the system 10 and method of the present invention is implemented or otherwise controlled through a dispatch computer 30. In such an embodiment, the dispatch computer 30, which is remote from the train TR, would obtain the appropriate estimated location area 18 from the positioning system 12, as well as the signal system data SD from the wayside devices WD associated with the tracks T in the track network TN in the estimated location area 18. If a dispatch computer 30 is used, the resulting train TR location data would be sent, transmitted or otherwise communicated to the train TR to update the on-board control system 28.

In a further embodiment, the system 10 includes at least one warning device 32, which is in communication with the computer 16, and which is capable of providing the operator with some visual and/or audible warning or alarm as a result of the determined possible train TR location. Since the computer 16 would have knowledge of the wayside devices WD in the area, e.g., the estimated location area 18, appropriate warnings could be provided to the operator based upon the received or determined data.

Still further, the computer 16 may be in communication with the braking system 34, which is configured to automatically brake the train TR based upon the determined train TR location, signal system data SD, etc. In addition, and as is known in the art, a display 36 can be provided in the train TR for use in presenting information and data to the operator. For example, the display 36 may present estimated location area 18, track location data 20, signal system data SD, track T data, possible train TR location, wayside device WD state data, wayside device WD status data, wayside device WD change data, wayside device WD behavior data, wayside device WD location data, direction of travel, track T route forward, track T route backward, best possible train TR location, etc. Furthermore, this display 36 may be part of the on-board control system 28, as is known in the art.

Figure 3A:
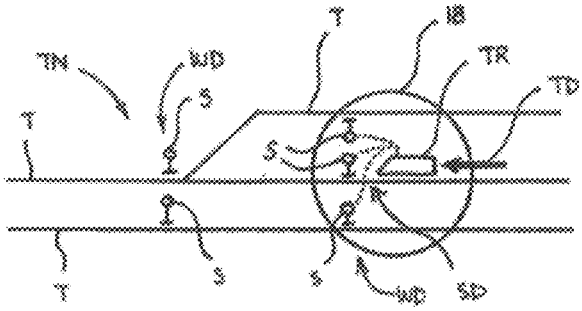
FIG. 3(*a*) is a schematic view of a step of a method and system for determining train location in a track network according to the principles of the present invention.
Figure 3B:
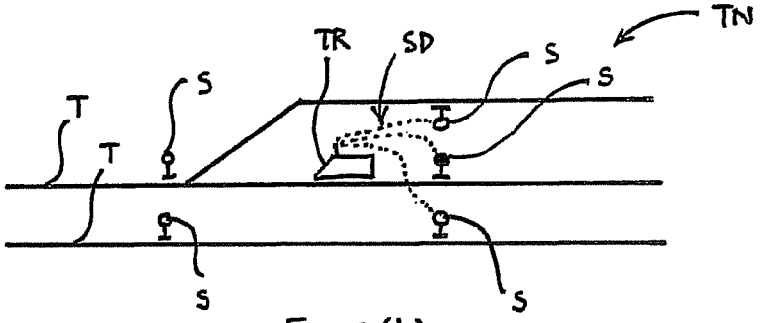

As discussed, the system 10 of the present invention uses the positioning system 12 to determine the estimated location area 18 of the train TR, as illustrated in FIG. 3(*a*). In this preferred and non-limiting embodiment, the wayside devices WD are signal devices S. As there are three tracks T in the estimated location area 18, the system 10 will obtain signal system data SD from the various signal devices S in the estimated location area 18, in this case, the three upcoming signal devices S. Next, and as illustrated in FIG. 3(*b*), signal system data SD from these three signal devices S is obtained after the train TR has been estimated to have passed these signal devices S. By comparing the "prior" signal system data SD and "after" signal system data SD, the system 10 can determine which track T the train TR is occupying. Since only one of the signal devices S exhibit modified signal system data SD, e.g., "red" or "stop" signal system data SD, it follows that it is this track T that the train TR is occupying. See FIG. 3(*b*). Accordingly, the system 10 is capable of providing accurate train location data by using the signal system data SD.

Figure 4A:
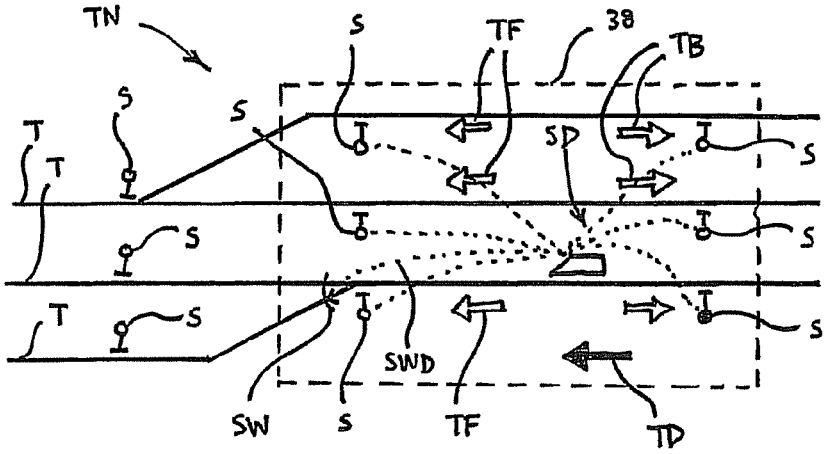
FIG. 4(*a*) is a schematic view of a step in a further embodiment of a method and system for determining train location in a track network according to the principles of the present invention.
Figure 4B:
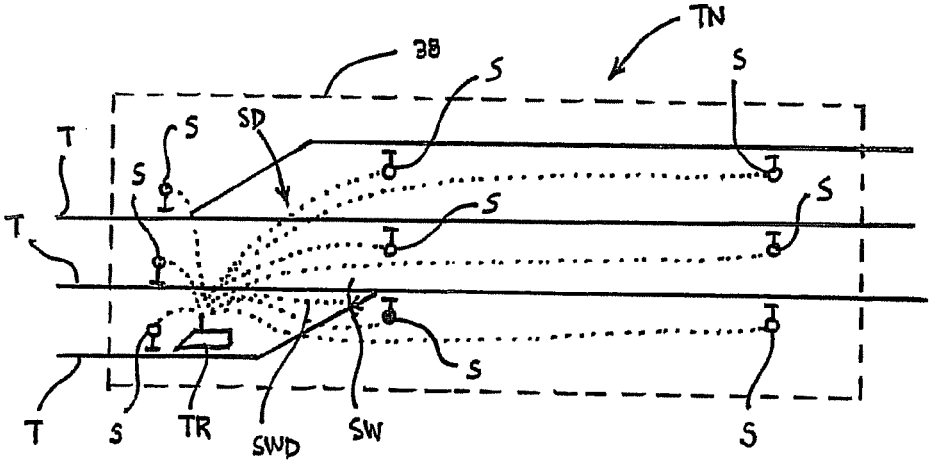

In a further embodiment directed to the use of signal devices S, and as illustrated in FIGS. 4(*a*)-(*b*), the computer 16 is configured or adapted to determine a direction of travel TD, a track route forward TF and/or a track route backward TB, with respect to the determination of possible locations of the train TR. By determining the travel direction TD, track route forward TF and/or track route backward TB, and by using the associate signal system data SD in the estimated location area 18, the system 10 provides an accurate determination of the location of the train TR.

Continuing with the embodiment of FIGS. 4(*a*)-(*b*), the system 10 may determine multiple possible train locations, and therefore, may operate as follows. First, the direction of travel TD of the train TR is determined. Next, the track route forward TF and/or the track route backward TB is determined for each of the multiple, possible train TR locations. Signal system data SD is obtained for relevant signal devices S associated with the track route forward TF and/or the track route backward TB for the possible train TR locations. Finally, a best possible train TR location is determined based upon the determined travel direction TD, the track route forward TF, the track route backward TB and/or the obtained signal system data SD. Accordingly, the computer 16 uses these data points to provide a best possible train TR location, which uses the signal system data SD of the signal devices S to pinpoint this location. Of course, this methodology is equally effective by obtaining the signal system data SD associated with a track circuit monitoring device MD.

In the still further non-limiting embodiment, the computer 16 determines or calculates an area of consideration 38. Further, this area of consideration 38 is determined based at least in part upon the track route forward TF, track route backward TB, as well as the determined estimated location area 18. In addition, the area of consideration 38 is determined to cover the necessary areas for all of the possible train TR locations. Next, and within this area of consideration 38, the computer 16 identifies one, and typically multiple, signal devices S that govern movement in the same direction the train TR is traveling or has traveled. The signal system data SD is obtained from the wayside devices WD (in this example, signal devices S).

In operation, the system 10 locates all signal devices S in a specified or dynamically-determined area with respect to the estimated location area 18. Since the train TR will be moving, and there are often communications delays, the area of consideration 38 should be large enough to account for any error in the positioning system 12, as well as the distance traveled by the train TR as a function of time required to communicate with the signal devices S. Once the area of consideration 38 has been determined, the system 10 may then determine which wayside devices WD within that area 38 govern the movement in the travel direction TD of the train TR. After this candidate set of wayside devices WD has been determined, the system 10 can obtain the signal system data SD as discussed above, e.g., establishing communication sessions with the appropriate wayside devices WD or wayside control units 22.

As discussed above, and as also illustrated in FIGS. 4(*a*)-(*b*) (and in one embodiment), the computer 16 identifies one or more wayside devices WD in the track route forward TF for the possible train TR locations in the estimated location area 18. Signal system data SD is obtained from relevant wayside devices WD prior to (track route forward TF) and after (track route backward TB) the train TR is estimated to have passed the wayside device WD. The signal system data SD is compared for each wayside device WD, and based upon this comparison, the best possible train TR location can be determined.

It should be noted that the best possible train TR location (or track T discrimination function) is an estimate. For example, based upon the system 10 and method of the present invention, when only one wayside device WD exhibits modified signal system data SD, e.g., "green" or "yellow" to "red" within an established time period from when the train TR has passed the signal device S, or indication of track occupancy by a track circuit monitoring device MD, the likelihood of the best possible train location being the actual train TR location is virtually 100%. However, if none of the or multiple wayside devices WD exhibit a modified signal aspect or signal system data SD, the actual position of the train TR is left unresolved. In this case, either additional train location techniques must be employed, e.g., manual, visual, cross-track error (CTE), etc. Further, a warning or alarm may be provided to the operator, which indicates that a location of the train TR is in question.

In one implementation, for each of the multiple possible train locations, the system 10 checks the signal system data SD (status) of each wayside device WD as the train TR approaches. If, in the case of a signal device S, the aspect or signal system data SD is anything other than a "stop" signal when the train TR approaches, the system 10 may place that signal device S in a list of signal devices S to be monitored for a specified period after the train passes (or has been determined to pass) the signal device S. In one embodiment, this wait period may be in the range of five to twenty seconds. If, at the end of this time period, one and only one signal device S displays a "stop" aspect, the train TR may be assumed to be on that track T, which is governed by that signal device S. This may also be employed with respect to track circuit monitoring devices MD, i.e., monitoring for a specified period to understand the status or condition.

In a still further embodiment, and again as illustrated in FIGS. 4(*a*)-(*b*), in some instances a switch SW may be in a position immediately after the wayside devices WD that have been used to determine position. In this instance, the computer 16 may obtain switch data SWD, such as from a wayside control unit 22 that manages that switch SW. If it is determined that the switch data SWD indicates that the train TR will change tracks T, the best possible train location will be modified accordingly. Therefore, the presently-invented system 10 and method are capable of dynamically determining the best possible train TR location from amongst multiple possible train TR locations based upon the positioning system 12 and data obtained from the wayside control units 22.

A system 10 and method described above can be used in a variety of implementations. The area of consideration 38 can be expanded or contracted as necessary, and is dynamically adjusted to ensure coverage of the appropriate wayside devices WD. For example, multiple wayside devices WD can be monitored in the track route forward TF and/or the track route backward TB in order to determine the best possible train location, or verify a previously-determined best possible train location. Therefore, the method employed may be iterative, and will follow the train TR as it traverses the track T in the direction of travel TD. A variety of algorithms and methodology can be used in determining changes in signal system data SD in the track network TN to determine locations of the trains TR.

Figure 5A:
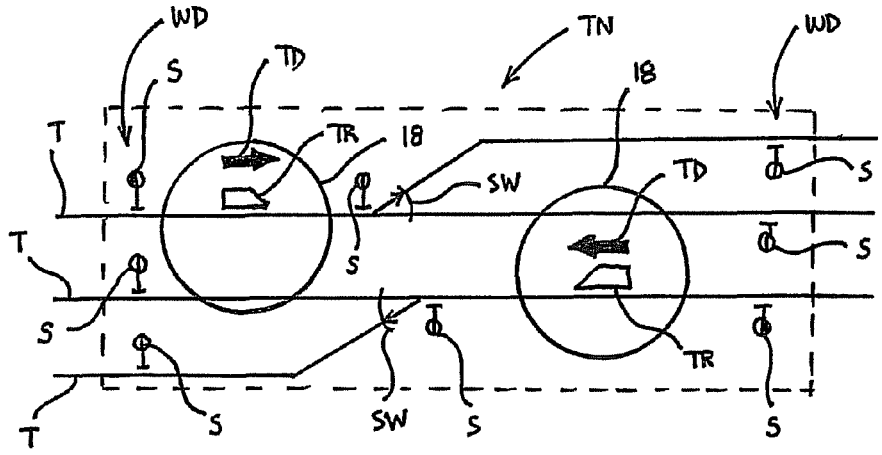
FIG. 5(*a*) is a schematic view of a step in a still further embodiment of a method and system for determining train location in a track network according to the principles of the present invention.
Figure 5B:
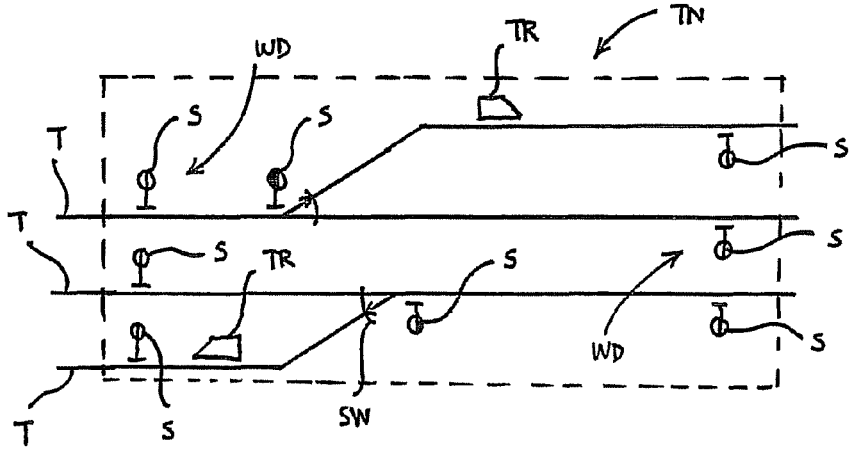

As illustrated in FIGS. 5(*a*)-5(*b*), the system 10 and method are also applicable and useful in connection with determining the best possible train TR location with multiple trains TR traversing adjacent tracks T in opposite directions. Using the two-way signal system data SD for the blocks of track T (and associated signal system data SD), the best possible train TR location for each train TR can be determined. Again, as discussed above, first the estimated location area 18 is determined for each train TR, and based upon the obtained signal system data SD, the location of each train TR can be determined and estimated. As discussed, the appropriate algorithm would be implemented by the computer 16 in determining the travel direction TD of each train TR, as well as the track route forward TF and/or track route backward TB for each possible location of each train TR.

Figure 6:
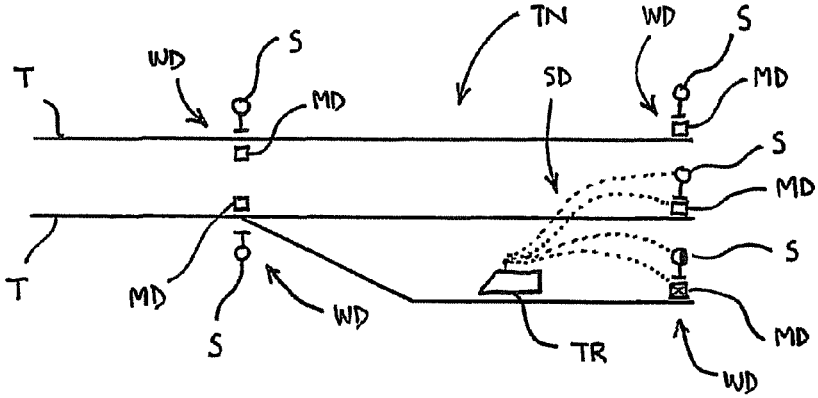
FIG. 6 is a schematic view of a step in another embodiment of a method and system for determining train location in a track network according to the principles of the present invention.

The preferred and non-limiting embodiment of FIG. 6 illustrates the monitoring of multiple track circuit monitoring devices MD, and determining estimated train TR position based upon signal system data SD received from these devices MD. In particular, the train TR (and in an alternate embodiment, the central dispatch computer 30) obtains signal system data SD in the form of a track occupancy indication, i.e., "occupied" or "not occupied". Since the "occupied" indication is only received from one of the two track circuit monitoring devices MD in the estimated location area 18, the computer 16 can infer that the train TR is positioned on the "occupied" track T. Of course, it is envisioned that the signal system data SD obtained from these track circuit monitoring devices MD can be used in any of the above-discussed implementations directed to signal devices S.

Accordingly, the system 10 can be used as a collision avoidance function to provide extra safety and analysis of trains TR located in the same general area, e.g., area of consideration 38, etc. Warnings and other alarms may be instituted and used in each train TR based upon the determined train TR locations. For example, if during the location determination method, it appears that two trains TR are traversing the same track T in a direction of collision, the appropriate warnings would be provided to the operator, or one or both of the trains TR would be automatically braked via the braking system 34.

While discussed in connection with the location of the computer 16 being on each individual train TR, such as in the on-board control system 28, the presently-invented system 10 and method may also be used in a complex multi-train management and control system, such as through the dispatch computer 30 or center. This would permit centralized monitoring, verification and control of multiple trains TR and a complex track network TN. In this manner, provided is a beneficial system 10 and method that allows for the determination of possible train TR locations based upon the use of signal system data SD. When the train TR may be on multiple tracks T based upon the estimated location area 18 determined by the positioning system 12, the system 10 and method allow for the effective determination of the best possible train TR location. Such a determination can accurately provide train TR location data, and in instances where such a determination is unresolved, appropriate warning or other safety features can be implemented. Furthermore, the system 10 and method can be used in both signal territory, where the signal system data SD can be obtained either wirelessly or through the rails, and is also effective in "dark" territory, as based upon the manual entry and visual awareness of the operator.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A system for determining a possible location of a train in a track network comprising a plurality of interconnected tracks having a plurality of wayside devices associated with the tracks, the system comprising:

a positioning system configured to determine an estimated location area of a train within the track network;

a track database comprising track location data;

a computer configured to:

(i) obtain the determined estimated location area of the train from the positioning system;

(ii) identify a plurality of tracks in the estimated location area of the train, based upon the track location data;

(iii) obtain signal system data for at least one wayside device associated with at least one of the plurality of tracks identified within the estimated location area;

(iv) determine at least one possible train location on at least one of the identified plurality of tracks based at least in part upon the obtained signal system data, wherein the signal system data comprises at least one of the following: wayside device change data, wayside device behavior data, or any combination thereof;

wherein, when a plurality of possible train locations is determined, the computer is further configured to:

determine a direction of travel of the train;

determine at least one of a track route forward and a track route backward for each of the plurality of possible train locations;

obtain signal system data for at least one wayside device associated with at least one of the track route forward and the track route backward for at least one of the plurality of possible train locations; and determine a best possible train location based upon at least one of the following: the determined direction of travel, the determined track route forward, the determined track route backward, the obtained signal system data.

2. The system of claim 1, wherein the positioning system is a global positioning system, the estimated location area comprising a circle with a radius of tolerance.

3. The system of claim 1, wherein the signal system data is obtained by receiving transmitted data by the at least one wayside device.

4. The system of claim 3, further comprising a receiver configured to receive or obtain the signal system data transmitted by the at least one wayside device.

5. The system of claim 1, wherein the signal system data is obtained through manual entry of an operator of the train based upon visual determination.

6. The system of claim 1, wherein at least one of the positioning system, track database and computer are located in at least one the train and a central dispatch location.

7. The system of claim 1, wherein the computer is further configured to determine a track route forward and/or a track route backward with respect to the at least one possible train location.

8. The system of claim 1, wherein the computer is further configured to:

determine an area of consideration based at least in part upon at least one of the track route forward and the track route backward for at least one of the plurality of possible train locations;

within the area of consideration, identify at least one wayside device that governs movement in the same direction the train is traveling; and obtain signal system data from the at least one wayside device.

9. The system of claim 8, wherein the computer is further configured to:

identify at least one wayside device in the track route forward for at least one of the plurality of possible train locations;

obtain signal system data from the at least one wayside device prior to and after the train is estimated to have passed the at least one wayside device; and compare the signal system data of the at least one wayside device prior to and after the train is estimated to have passed the at least one wayside device.

10. The system of claim 1, wherein, prior to determining the best possible train location, the computer is further configured to obtain switch data.

11. The system of claim 1, further comprising at least one warning device in communication with the computer and configured to provide a warning based at least in part upon the determined possible train location.

12. The system of claim 1, further comprising a braking system in communication with the computer and configured to automatically brake the train based at least in part upon the determined possible train location.

13. The system of claim 1, further comprising a display configured to present at least one of the following: estimated location area, track location data, signal system data, track data, possible train location, wayside device state data, wayside device status data, wayside device change data, wayside device behavior data, wayside device location data, occupancy data, direction of travel, track route forward, track route backward, best possible train location.

14. A method for determining a possible location of a train in a track network comprising a plurality of interconnected tracks having a plurality of wayside devices associated with the tracks, the method comprising:

(a) obtaining a determined estimated location area of the train;

(b) identifying a plurality of tracks in the estimated location area of the train;

(c) obtaining signal system data for at least one wayside device associated with at least one of the plurality of tracks identified within the estimated location area;

(d) determining at least one possible train location on at least one of the identified plurality of tracks based upon the obtained signal system data, wherein the signal system data comprises at least one of the following: wayside device change data, wayside device behavior data, or any combination thereof;

wherein a plurality of possible train locations is determined, the method further comprising:

determining a direction of travel of the train;

determining at least one of a track route forward and a track route backward for each of the plurality of possible train locations;

obtaining signal system data for at least one wayside device associated with at least one of the track route forward and the track route backward for at least one of the plurality of possible train locations; and determining a best possible train location based up on at least one of the following: the determined direction of travel, the determined track route forward, the determined track route backward, the obtained signal system data.

15. The method of claim 14, further comprising determining a track route forward and/or a track route backward with respect to the at least one possible train location.

16. The method of claim 14, further comprising:

determining an area of consideration based at least in part upon at least one of the track route forward and the track route backward for at least one of the plurality of possible train locations;

within the area of consideration, identifying at least one wayside device that governs movement in the same direction the train is traveling; and obtaining signal system data from the at least one wayside device.

17. The method of claim 16, further comprising:

identifying at least one wayside device in the track route forward for at least one of the plurality of possible train locations;

obtaining signal system data from the at least one wayside device prior to and after the train is estimated to have passed the at least one wayside device; and comparing the signal system data of the at least one wayside device prior to and after the train is estimated to have passed the at least one wayside device.

18. The method of claim 14, wherein, prior to determining a best possible train location, the method further comprises obtaining switch data.

19. The method of claim 14, further comprising providing a warning to an operator of the train based at least in part upon the determined possible train location.

20. The method of claim 14, further comprising automatically braking the train based at least in part upon the determined possible train location.

21. The method of claim 14, wherein at least one of the steps are performed automatically by a computer.

* * * * *

UNITED STATES PATENT AND TRADEMARK OFFICE

CERTIFICATE OF CORRECTION

PATENT NO. : 8,214,091 B2
APPLICATION NO. : 11/874430
DATED : July 3, 2012
INVENTOR(S) : Jeffrey D. Kernwein It is certified that error appears in the above-identified patent and that said Letters Patent is hereby corrected as shown below:

Column 12, Line 50, Claim 14, delete “up on” and insert -- upon --

Signed and Sealed this
Twenty-third Day of October, 2012

David J. Kappos

David J. Kappos
*Director of the United States Patent and Trademark Office*